United States Patent [19]

Marszalek et al.

[11] 3,938,629

[45] Feb. 17, 1976

[54] RAILWAY TRACK BRAKE

[75] Inventors: Leszek Marszalek; Tadeusz Lorenc, both of Rybnik; Andrzej Hodbod, Katowice, all of Poland

[73] Assignee: Centralny Osrodek Badan i Rozwoju Techniki Kolejnictwa, Warsaw, Poland

[22] Filed: Aug. 8, 1974

[21] Appl. No.: 495,841

[30] Foreign Application Priority Data

Aug. 10, 1973 Poland ..... 164594

[52] U.S. Cl. ..... 188/62; 104/257; 188/38; 188/129

[51] Int. Cl.[2] ..... B61K 7/02

[58] Field of Search ..... 188/62, 32, 111, 129, 37, 188/38, 38.5; 104/249, 257

[56] References Cited

UNITED STATES PATENTS

| | | | |
|---|---|---|---|
| 1,766,559 | 6/1930 | Stephenson | 188/62 |
| 1,825,899 | 10/1931 | Deloison | 188/62 |
| 2,588,798 | 3/1952 | Bone et al. | 188/62 |
| 2,633,210 | 3/1953 | Beltman et al. | 188/62 |
| 3,128,721 | 4/1964 | McGowan | 188/62 |
| 3,160,233 | 12/1964 | Norman et al. | 188/129 |
| 3,503,471 | 3/1970 | Balke | 104/249 |

FOREIGN PATENTS OR APPLICATIONS

| | | | |
|---|---|---|---|
| 733,207 | 7/1955 | United Kingdom | 188/62 |
| 852,859 | 10/1952 | Germany | 188/129 |

*Primary Examiner*—Trygve M. Blix
*Assistant Examiner*—Edward R. Kazenske
*Attorney, Agent, or Firm*—Haseltine, Lake & Waters

[57] ABSTRACT

A railway track brake comprising a series of segments connected together in pairs and installed transversely between the rails of the track, each segment including a top beam with a shaft rotatably installed inside the top beam and provided at its ends with projecting arms carrying contact rollers for engagement with the wheels of the vehicle to be braked. The top beam is rotated with the shaft when the vehicle wheels contact the rollers and rotate the arms. The top beam is connected to a bottom beam which is linearly displaceable by means of a crank and a connecting rod. The bottom beam is connected to an energy absorbing device including a strip having a friction lining in contact with rotatable rolls. The bottom beams of each pair of segments are interconnected by a double-arm lever such that the bottom beams move in opposite directions.

6 Claims, 3 Drawing Figures

RAILWAY TRACK BRAKE

The invention relates to a railway brake for reducing the speed of railway wagons shunted in shunting yards.

There are the known railway brakes which are rubber-type rail brakes operating on the principle of rolling resistance on flexible materials. The braking element is a movable rail with rubber lining, this rail being raised above the fixed steel rail. In braking, the treads of the wheels roll on the movable rails and as soon as the wagon is braked the movable rail is lowered and the wheels of the wagon roll with their flanges on the fixed steel rail. The magnitude of braking force depends on the weight of the wagon. The imperfection of a construction of this type is the fact that a considerable part of kinetic energy which the rolling wheel of the wagon imparts to the rubber which is being compressed is returned to this wheel by the elastic recovery of the rubber to its original state. The rate of absorbed kinetic energy is determined by the field of hysteresis of rubber. Besides, a direct contact between the rough wagon wheel treads and rubber lining results in wear of rubber. There are also known segment type rubber brakes where no direct contact takes place between the braked wheel of the wagon and the rubber. Absorption of kinetic energy of a shunted wagon takes place by the wagon wheels hitting pressure pins projecting above the rail head, these pins being thus pressed vertically down and causing flexible links with rubber linings to be turned through a certain angle. The rubber elements are compressed and twisted, and since an internal friction takes place in the rubber the kinetic energy is absorbed. The imperfection of a construction of this type is that only a comparatively small part of the kinetic energy of the wagon is absorbed by the rubber elements. There is also vibration generated in flexible elements, this vibration causing rapid wear of the brake elements. Also known and used are DOWTY type railway track brakes, the braking effect of these brakes being based on the principle of a point operation. In the brakes of this type, hydraulic absorbers are disposed along the rail head, the tops of plungers of these absorbers being covered with heads which are pressed down vertically by the tread of the wheels of a wagon which is being braked, so that the resistance of hydraulic liquid flowing through holes of small diameter is used. The hydraulic absorbers are connected with a pressure plant by means of a central conduit, a variable pressure being produced in this pressure plant, and depending on the speed of the shunted wagon either braking or pushing of the wagon is obtained, by means of a suitable control system. The imperfection of a construction of this type is that due to a fairly high pressure in the conduits, a highly leakproof hydraulic system is required for resisting variable pressures and vibration caused by the shunted wagons. The above described constructions of known types of railway track brake include very complex pressure plants which require constant attention and maintenance, these pressure plants being one more element which is liable to failure.

An object of the present invention is to provide a railway track brake of comparatively simple construction and reliable in operation, this brake not requiring any additional equipment such as a complex pressure plant, and reliably operating in all weather conditions.

The railway track brake of the invention comprises a series of segments connected together, said segments being installed in pairs across the railway track. Each segment has a top beam rotatably fixed in bearings and connected with a bottom beam by means of cranks and connecting rods. There is a shaft installed in bearings inside the top beam, said shaft being provided with arms at its ends, said arms having pressure rolls mounted thereon. The bottom beams of one pair of brake segments are interconnected, through links, by means of double-arm levers, said beams being also connected with movable strips of absorbers, said absorbers being fixed to a foundation beam. The top beam together with the shaft can be turned in the direction in which the braked wagons are moving. At the moment when the wheel flange comes into contact with the pressure roll, as well as during the following turn of the said roll, a slight shift of the absorber strip follows along with considerably increasing angle of rotation of the pressure roll, so that the resistance brought into action by the roll gradually increases from zero. Before the wagon wheel hits the pressure roll, the cranks and the connecting rods are positioned in a straight line. The absorber has at least one movable strip provided with flexible material linings, said strip moving between the rows of metal or flexible material rolls under the action of the pressure roll which is turned and moved by the wheels of the wagon. The rolls are rotatably mounted in guides, said guides being pressed against the strip. There is a recoil mechanism included in the bottom part of the absorber. When hitting the pressure rolls of one segment of the brake, the wheels of a shunted wagon cause the shaft and the top beam to be turned, and the bottom beam to be shifted by the crank and the vertical connecting rod, together with the strips of the absorbers. In this way the rotably mounted rolls roll against the flexible linings, and the kinetic energy of the shunted wagon is absorbed. Each segment of the brake absorbs a certain definite amount of energy. In accordance with the required braking effect, namely in accordance with the required loss in kinetic energy, i.e. whether slowing down or full stopping of wagon or of a line of wagons by means of the brake is desired, either all or only some of the brake segments are put into operation. Exclusion of separate segments from operation is obtained by turning, by means of electromagnetic devices, of the shafts with the pressure rolls from a vertical position by 90° in the direction opposite to that in which the top beam turns. In the case when a shunting locomotive or wagons which do not require braking are moving on the track in which the brake is installed, all segments of the brake can be disengaged by means of electromagnetic devices.

A characteristic feature of the railway track brake according to the invention is its compact and simple construction which does not require a complex pressure plant, since the operation of the brake is self-contained. Another feature of the brake is that the absorbers absorb the entire energy transmitted at the moment when the wheel of a braked wagon hits the pressure roll, thus providing a braking effect which is several times greater in comparison, for example, with a brake having a movable rail with a rubber lining.

An embodiment of the invention will now be described by way of example and with reference to the accompanying drawing in which.

Figure 1:
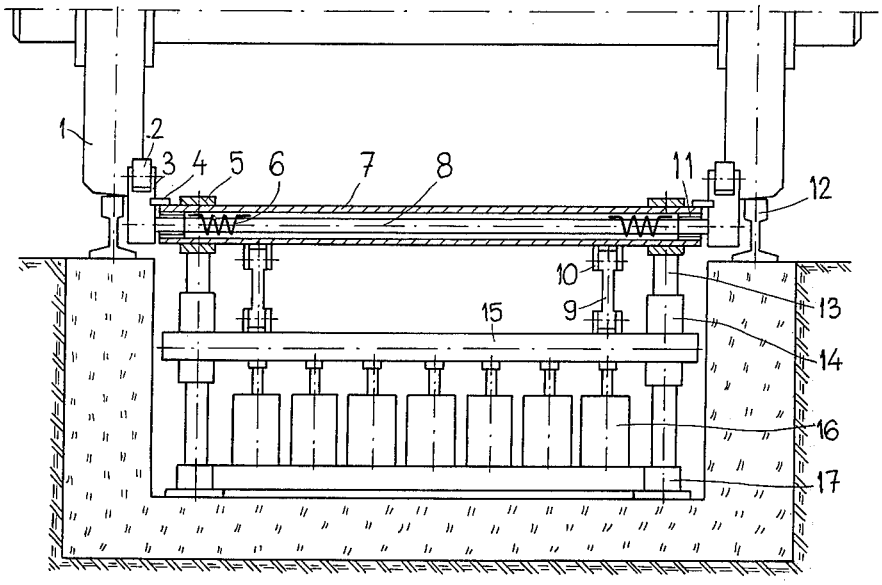
FIG. 1 illustrates a segment of the brake in cross-section.
Figure 2:
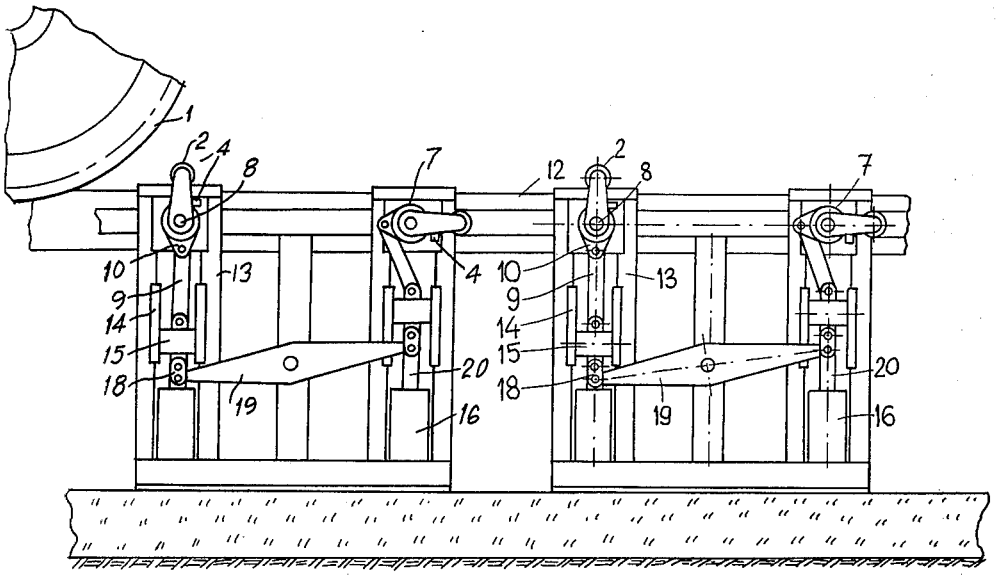
FIG. 2 illustrates in a side view a pair of segments.
Figure 3:
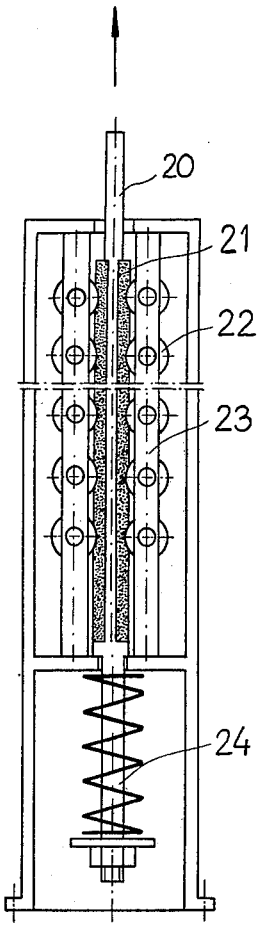
FIG. 3 illustrates the absorber in a vertical section.

The railway track brake according to the invention consists of several tens of pairs of segments situated one beside the other between rails 12 on which travel wheel sets 1 of wagons shunted from a hump. Each segment includes a top beam 7 mounted in bearings 5, said bearings being installed in the top part of brackets 13, said brackets also serving as a guide for a bottom beam 15. The top beam 7 is connected with the bottom beam 15 by means of cranks 10 and connecting rods 9. A shaft 8 is installed in bearings 11 inside the top beam 7, said shaft being provided with arms 3 at its ends, said arms having pressure rolls 2 mounted on the said arms. The arms 3 are pressed against protrusions 4 on top beam 7 by means of springs 6 engaged between beam 7 and shaft 8. There are movable strips 20 of absorbers 16 fixed to the bottom beam 15, said absorbers 16 being fixed to a foundation beam 17. As is illustrated in FIG. 2, the bottom beams of each pair of segments are interconnected in their opposite end positions by means of double-arm levers 19 through links 18 in such a manner that strips 20 of absorbers 16 of one segment are moving upward while the strips 20 of the absorbers 16 of the other segment are moving downward. The absorber 16 illustrated in FIG. 3 consists of a movable strip 20 provided with flexible material linings 21, and guides 23, rolls 22 being rotably mounted in the said guides and being urged against the strip 20. There is a recoil mechanism 24 included in the bottom part of the absorber 16.

The operation of the brake is as follows. For a wagon or for a draft of wagons shunted from a hump the amount of energy which the wagon should lose in the brake in order to reach its destination is computed in a digital computer. The speed at which the wagon is approaching its destination for coupling it with a line of wagons should be no more than 1 m/sec. In accordance with the computed value of energy which has to be absorbed, a suitable number of segments remains in operation while the other segments are automatically disengaged as for example by retracting rolls 2 by electromagnetic action to rotate shaft 8 90° counterclockwise, i.e. in the direction opposite to the direction of rotation of beam 7 which effects braking. The wagon wheels 1 hitting the pressure rolls 2 of the first segment turn the beam 7 via arms 3 and protrusions 4 and cause, through the cranks 10 and connecting rods 9, the bottom beam 15 and the strips 20 of absorbers 16 to be shifted. A vertical shift of bottom beam 15 upwards causes, by means of double-arm lever 19, the bottom beam 15 of the second segment to be shifted downwards, whereby the top beam 7 shaft 8, and the arms 3, are turned such that the arms 3 and rods 9 assume a vertical position.

A stopping distance of 20 meters will be obtained for a two-bogie, four axle 80 ton wagon with axles running in antifriction bearings and whose speed before contact with the first segment of the railway track brake of the invention is 8 m/sec.

What we claim is:

1. A railway track brake comprising a plurality of pairs of brake segments disposed transversely between rails for braking the wheels of a vehicle traveling on the rails, each segment comprising a rotatable top beam, a shaft rotatably supported by said top beam and having ends with projecting arms, contact means on said arms for being contacted by the wheels of the vehicle to be braked to cause rotation of said arms, means for producing rotation of said top beam in accordance with rotation of said arms, a displaceable bottom beam, means guidably supporting the bottom beam for linear displacement, a crank secured for rotation with said top beam, a connecting rod pivotably connected to said crank and to said bottom beam to displace the latter upon rotation of said crank, energy absorber means coupled to said bottom beam for resisting displacement thereof, and a double arm lever having ends pivotably interconnecting the bottom beams of each pair of brake segments so that said bottom beams move in opposite directions.

2. A railway track brake as claimed in claim 1 wherein said means for producing rotation of the top beam in accordance with rotation of said arms comprises a protrusion fixed on said top beam facing each arm.

3. A railway track brake as claimed in claim 1 wherein said crank and rod of each segment are aligned in a straight line when the wheels of a vehicle contact the contact means on the associated arm.

4. A railway track brake as claimed in claim 1 wherein said energy absorber means comprises a movable strip coupled to the bottom beam of the associated segment, a plurality of rolls flanking said strip, flexible material on said rolls, and guides rotatably supporting said rolls with said flexible material thereon in contact with said strip.

5. A railway track brake as claimed in claim 4 comprising a recoil mechanism acting on said strip to urge the same in a direction opposing displacement by said connecting rod.

6. A railway track brake as claimed in claim 1 wherein said contact means comprises rotatable rolls on said arms.

* * * * *